US009266639B2

(12) United States Patent
Cluett et al.

(10) Patent No.: US 9,266,639 B2
(45) Date of Patent: Feb. 23, 2016

(54) BLIND PACKAGING AND METHODS OF CUTTING WINDOW COVERINGS

(75) Inventors: Timothy D. Cluett, Summerfield, NC (US); Kristi Jane Georgi, Dunwoody, GA (US); Brian Bellamy Johnson, Atlanta, GA (US); James McCauley, Roswell, GA (US); William Norris Scott, Decatur, GA (US); Martin Richard Van Buren, Atlanta, GA (US); Russell Dudley Wooten, Mebane, NC (US)

(73) Assignee: Newell Window Furnishings, Inc., High Pointe, NC (US)

( * ) Notice: Subject to any disclaimer, the term of this patent is extended or adjusted under 35 U.S.C. 154(b) by 429 days.

(21) Appl. No.: 12/839,083

(22) Filed: Jul. 19, 2010

(65) Prior Publication Data

US 2012/0012484 A1 Jan. 19, 2012

(51) Int. Cl.
*B65D 85/00* (2006.01)
*B65D 5/42* (2006.01)
(Continued)

(52) U.S. Cl.
CPC . *B65D 5/42* (2013.01); *E06B 9/266* (2013.01); *E06B 9/30* (2013.01); *Y10T 83/04* (2015.04)

(58) Field of Classification Search
CPC ..... B65D 5/04; B65D 5/12; B65D 5/029; B65D 5/38
USPC ..... 206/321, 325–326, 320, 422, 446, 443, 206/593, 594, 453, 495, 478, 779–780; 229/121, 125.15, 125.19, 122.3, 161, 229/163, 93, 164, 125.125; 49/74.1; 160/166.1
See application file for complete search history.

(56) References Cited

U.S. PATENT DOCUMENTS 163,935 A * 6/1875 Lewinson ..... 206/443
239,691 A 4/1881 Appleton
421,027 A 2/1890 Hammond
(Continued)

FOREIGN PATENT DOCUMENTS

CA 2136519 A1 5/1996
CA 2355507 A1 2/2003
(Continued)

OTHER PUBLICATIONS

U.S. Appl. No. 10/908,728, filed May 24, 2005.
(Continued)

*Primary Examiner* — Anthony Stashick
*Assistant Examiner* — Robert Poon
(74) *Attorney, Agent, or Firm* — Sutherland Asbill & Brennan LLP

(57) ABSTRACT

A package for a size-in-store window covering comprises a box having a first portion that extends for the width of the window covering and a second portion that extends for less than the width of the window covering. The window covering extends beyond an end of a bottom wall a first distance and the head rail extends beyond an end of a first side wall a second distance. A method of cutting a window covering comprises providing a window covering in a box as described above and positioning the box with the exposed portion of the window covering facing down and the exposed portion of the head rail facing a clamp. Methods of packaging a window covering comprise reducing the total number of loops in the window covering, and positioning inserts between adjacent components.

9 Claims, 10 Drawing Sheets

(51) Int. Cl.
*E06B 9/266* (2006.01)
*E06B 9/30* (2006.01)

(56) References Cited

U.S. PATENT DOCUMENTS

| | | | | | |
|---|---|---|---|---|---|
| 702,200 | A | | 6/1902 | Greene | |
| 1,382,433 | A | | 6/1921 | McCarty | |
| 1,647,254 | A | | 11/1927 | Simmons | |
| 1,721,276 | A | | 7/1929 | Marsilius | |
| 1,792,522 | A | | 2/1931 | Yates | |
| 1,924,162 | A | | 8/1933 | Mason | |
| 2,044,481 | A | | 6/1936 | Manley et al. | |
| 2,057,488 | A | | 10/1936 | Hochstadt | |
| 2,247,314 | A | | 6/1941 | Sellmeyer | |
| 2,316,657 | A | * | 4/1943 | Wright | 206/395 |
| 2,418,515 | A | | 4/1947 | Lewis | |
| D155,897 | S | | 11/1949 | Huntington | |
| 2,631,508 | A | | 3/1953 | Muehling | |
| 2,644,520 | A | | 7/1953 | Nelson | |
| 2,691,994 | A | | 10/1954 | Ferguson | |
| 2,747,625 | A | | 5/1956 | Small | |
| 2,789,639 | A | | 4/1957 | Lorentzen | |
| 2,806,493 | A | | 9/1957 | Gaskell | |
| 2,827,686 | A | | 3/1958 | Adelman | |
| 2,883,736 | A | | 4/1959 | Crane | |
| 2,949,943 | A | | 8/1960 | Islandsrud | |
| 2,987,085 | A | | 6/1961 | Porter | |
| 3,181,768 | A | * | 5/1965 | Flynn et al. | 206/326 |
| 3,260,146 | A | | 7/1966 | Child | |
| 3,263,544 | A | | 8/1966 | Margolien | |
| 3,292,232 | A | | 12/1966 | Nilsson | |
| 3,391,591 | A | | 7/1968 | Funke | |
| 3,470,926 | A | | 10/1969 | Dohm | |
| 3,513,740 | A | | 5/1970 | Burghart | |
| 3,564,893 | A | | 2/1971 | Richards et al. | |
| 3,584,380 | A | | 6/1971 | Mehler et al. | |
| 3,618,297 | A | | 11/1971 | Hamrick | |
| 3,634,975 | A | | 1/1972 | Hensley | |
| 3,664,221 | A | | 5/1972 | Breetvelt | |
| 3,677,117 | A | | 7/1972 | Cutter | |
| 3,715,946 | A | | 2/1973 | Kaltenbach | |
| 3,736,631 | A | | 6/1973 | Edixhoven | |
| 3,750,509 | A | | 8/1973 | Kruse | |
| 3,766,815 | A | | 10/1973 | Edixhoven | |
| 3,917,065 | A | * | 11/1975 | Pape | 206/326 |
| 4,018,188 | A | | 4/1977 | Burdette | |
| 4,036,092 | A | | 7/1977 | Kaltenbach | |
| 4,055,206 | A | | 10/1977 | Griffin | |
| 4,067,252 | A | | 1/1978 | Peddinghaus et al. | |
| 4,130,237 | A | * | 12/1978 | Struble | 229/121 |
| 4,139,043 | A | | 2/1979 | Donofrio | |
| 4,151,768 | A | | 5/1979 | Shockovsky | |
| 4,188,693 | A | | 2/1980 | Edixhoven | |
| 4,201,256 | A | | 5/1980 | Truhan | |
| 4,214,493 | A | | 7/1980 | Elhaus | |
| 4,227,902 | A | | 10/1980 | Olson | |
| 4,230,005 | A | | 10/1980 | Varga | |
| 4,233,782 | A | | 11/1980 | Perrault | |
| 4,262,564 | A | | 4/1981 | Kaltenbach | |
| 4,270,253 | A | | 6/1981 | Herb et al. | |
| 4,326,864 | A | | 4/1982 | Sittler | |
| 4,338,710 | A | | 7/1982 | Stursa et al. | |
| 4,367,665 | A | | 1/1983 | Terpstra et al. | |
| 4,407,614 | A | | 10/1983 | Muhr et al. | |
| 4,457,197 | A | | 7/1984 | Wepner et al. | |
| 4,468,995 | A | | 9/1984 | Mireles-Saldivar | |
| 4,492,301 | A | | 1/1985 | Inaba et al. | |
| 4,545,100 | A | | 10/1985 | Gaillard et al. | |
| 4,567,930 | A | | 2/1986 | Fischer | |
| 4,576,072 | A | | 3/1986 | Terpstra et al. | |
| 4,589,312 | A | | 5/1986 | Meyers et al. | |
| 4,589,313 | A | | 5/1986 | Meyers et al. | |
| 4,606,099 | A | | 8/1986 | Schluep et al. | |
| 4,619,166 | A | | 10/1986 | Valavaara | |
| 4,625,868 | A | | 12/1986 | Bischof | |
| 4,639,987 | A | | 2/1987 | Georgopoulos | |
| 4,726,273 | A | | 2/1988 | Miceli | |
| 4,730,372 | A | | 3/1988 | Tsuchida | |
| 4,771,667 | A | | 9/1988 | Forman et al. | |
| 4,776,096 | A | | 10/1988 | Chang | |
| 4,790,226 | A | | 12/1988 | Tsuchida | |
| 4,807,363 | A | | 2/1989 | Clifton, Jr. | |
| 4,819,530 | A | | 4/1989 | Huang | |
| 4,823,449 | A | | 4/1989 | Chang | |
| 4,876,795 | A | | 10/1989 | Chun-cheng | |
| 4,901,419 | A | | 2/1990 | Voss | |
| 4,907,325 | A | | 3/1990 | Hsu | |
| 4,907,337 | A | | 3/1990 | Krüsi | |
| 4,924,740 | A | | 5/1990 | Wright | |
| 4,928,369 | A | | 5/1990 | Schnebly et al. | |
| 4,987,765 | A | | 1/1991 | Nishimura et al. | |
| 4,993,131 | A | | 2/1991 | Graves et al. | |
| D316,979 | S | | 5/1991 | Reynolds | |
| 5,037,253 | A | | 8/1991 | Molaro et al. | |
| 5,054,206 | A | | 10/1991 | Carlson | |
| 5,056,388 | A | | 10/1991 | Dekker et al. | |
| 5,060,709 | A | | 10/1991 | Simon | |
| 5,072,494 | A | | 12/1991 | Graves et al. | |
| 5,103,702 | A | | 4/1992 | Yannazzone | |
| 5,119,854 | A | | 6/1992 | Chanoine et al. | |
| 5,215,512 | A | | 6/1993 | De Dompierre | |
| 5,251,382 | A | | 10/1993 | Hellar | |
| 5,339,716 | A | | 8/1994 | Sands et al. | |
| 5,349,730 | A | | 9/1994 | Anderson et al. | |
| 5,392,524 | A | | 2/1995 | Hill | |
| 5,456,149 | A | | 10/1995 | Elsenheimer et al. | |
| 5,584,393 | A | * | 12/1996 | Korte | 206/524.9 |
| 5,667,152 | A | | 9/1997 | Mooring | |
| 5,740,053 | A | | 4/1998 | Iwama | |
| 5,787,774 | A | | 8/1998 | Richards et al. | |
| 5,799,557 | A | | 9/1998 | Wang | |
| 5,806,245 | A | | 9/1998 | Satrom | |
| 5,806,394 | A | | 9/1998 | Marocco | |
| 5,816,126 | A | | 10/1998 | Pluber | |
| 5,819,619 | A | | 10/1998 | Miller et al. | |
| 5,826,317 | A | | 10/1998 | van Oostrom et al. | |
| 5,882,155 | A | | 3/1999 | Testa, Jr. | |
| 5,927,172 | A | | 7/1999 | Wang | |
| 5,943,932 | A | | 8/1999 | Sberveglieri | |
| 5,971,839 | A | | 10/1999 | Schmelzer | |
| 6,003,217 | A | | 12/1999 | Graves et al. | |
| 6,003,218 | A | | 12/1999 | Schumann et al. | |
| 6,079,306 | A | | 6/2000 | Liu | |
| 6,089,134 | A | | 7/2000 | Marocco | |
| 6,098,694 | A | | 8/2000 | Ohanesian | |
| 6,142,196 | A | | 11/2000 | Schumann et al. | |
| 6,167,789 | B1 | | 1/2001 | Daniels et al. | |
| 6,178,857 | B1 | | 1/2001 | Marocco | |
| 6,196,099 | B1 | | 3/2001 | Marocco | |
| 6,202,014 | B1 | | 3/2001 | Brandt et al. | |
| 6,240,824 | B1 | | 6/2001 | Hsu | |
| 6,263,945 | B1 | | 7/2001 | Nien | |
| 6,314,851 | B1 | | 11/2001 | Graves et al. | |
| 6,334,379 | B1 | | 1/2002 | Sudano | |
| 6,336,388 | B1 | | 1/2002 | Marocco | |
| 6,362,893 | B1 | | 3/2002 | Francis et al. | |
| 6,405,406 | B1 | | 6/2002 | Chen | |
| 6,412,381 | B1 | | 7/2002 | Wang et al. | |
| 6,418,762 | B1 | | 7/2002 | Münch et al. | |
| 6,427,571 | B1 | | 8/2002 | Hsu | |
| 6,435,066 | B1 | | 8/2002 | Kutchmarek et al. | |
| 6,500,048 | B1 | | 12/2002 | Bär | |
| 6,535,294 | B1 | | 3/2003 | Arledge, Jr. et al. | |
| 6,560,849 | B1 | | 5/2003 | Modra | |
| 6,561,121 | B1 | | 5/2003 | Rose | |
| 6,604,443 | B2 | | 8/2003 | Roberts et al. | |
| 6,615,698 | B2 | | 9/2003 | Chuang et al. | |
| 6,644,160 | B1 | | 11/2003 | Boselli | |
| 6,681,673 | B1 | | 1/2004 | Kutchmarek et al. | |
| 6,688,204 | B2 | | 2/2004 | Huang | |
| 6,758,120 | B2 | | 7/2004 | Marocco | |
| 6,758,257 | B2 | | 7/2004 | Lee | |
| 6,761,099 | B2 | | 7/2004 | Lin et al. | |
| 6,783,563 | B1 | | 8/2004 | Eckhoff et al. | |

(56) References Cited

U.S. PATENT DOCUMENTS

| | | | | |
|---|---|---|---|---|
| 6,793,073 | B2 | 9/2004 | Tu | |
| 6,865,817 | B2 | 3/2005 | Militello et al. | |
| 6,877,409 | B2 | 4/2005 | Huang et al. | |
| 6,912,940 | B1 | 7/2005 | Atwood | |
| 6,971,296 | B2 | 12/2005 | Lin et al. | |
| 6,973,364 | B2 | 12/2005 | Schwartz et al. | |
| 7,000,516 | B2 | 2/2006 | Lin et al. | |
| 7,000,521 | B1 | 2/2006 | Cheng et al. | |
| 7,007,576 | B2 | 3/2006 | Roberts et al. | |
| 7,017,459 | B2 | 3/2006 | Marocco | |
| 7,024,977 | B2 | 4/2006 | Nien | |
| 7,036,412 | B2 | 5/2006 | Abdollahzadeh | |
| 7,040,205 | B2 | 5/2006 | Roberts et al. | |
| 7,044,043 | B2 | 5/2006 | Cheng | |
| 7,059,230 | B2 | 6/2006 | Caputo et al. | |
| 7,069,832 | B2 | 7/2006 | Roberts et al. | |
| 7,069,833 | B2 | 7/2006 | Roberts et al. | |
| 7,100,485 | B2 | 9/2006 | Roberts et al. | |
| 7,104,175 | B2 | 9/2006 | Roberts et al. | |
| 7,107,889 | B2 | 9/2006 | Marocco | |
| 7,114,421 | B2 | 10/2006 | Marocco | |
| 7,124,672 | B2 | 10/2006 | Marocco | |
| 7,178,439 | B2 | 2/2007 | Gilboy et al. | |
| 7,194,811 | B2 | 3/2007 | Militello et al. | |
| 7,278,345 | B2 | 10/2007 | Schimmels | |
| 7,404,430 | B2 * | 7/2008 | Kollman et al. | 160/178.1 R |
| 7,444,910 | B2 | 11/2008 | Marocco | |
| RE40,605 | E | 12/2008 | Kutchmarek et al. | |
| 7,467,578 | B2 | 12/2008 | Marocco | |
| 7,506,567 | B2 | 3/2009 | Simokovic | |
| 8,065,861 | B2 * | 11/2011 | Caputo | 53/445 |
| 2003/0033919 | A1 | 2/2003 | Lin et al. | |
| 2003/0066403 | A1 | 4/2003 | Lin et al. | |
| 2003/0140756 | A1 | 7/2003 | Lin et al. | |
| 2003/0155258 | A1 | 8/2003 | Tu | |
| 2003/0196530 | A1 | 10/2003 | Roberts et al. | |
| 2004/0103767 | A1 | 6/2004 | Lin et al. | |
| 2005/0188515 | A1 | 9/2005 | Reimer et al. | |
| 2006/0065086 | A1 | 3/2006 | Swopes et al. | |
| 2006/0108078 | A1 | 5/2006 | Kollman et al. | |
| 2006/0156882 | A1 | 7/2006 | Kollman et al. | |
| 2006/0179991 | A1 | 8/2006 | Nien et al. | |
| 2006/0207399 | A1 | 9/2006 | Birch et al. | |
| 2006/0289125 | A1 | 12/2006 | Kollman et al. | |
| 2007/0000363 | A1 | 1/2007 | Kollman et al. | |
| 2007/0175783 | A1 * | 8/2007 | Nien | 206/320 |
| 2007/0239551 | A1 | 10/2007 | Zeller | |
| 2007/0277657 | A1 | 12/2007 | Hilgendorf et al. | |
| 2007/0295176 | A1 | 12/2007 | Kollman et al. | |
| 2008/0034933 | A1 | 2/2008 | Roberts et al. | |
| 2008/0066283 | A1 | 3/2008 | Birch et al. | |
| 2008/0087152 | A1 | 4/2008 | Kollman et al. | |
| 2009/0019978 | A1 | 1/2009 | Kollman | |
| 2009/0031876 | A1 | 2/2009 | Caputo et al. | |
| 2009/0071307 | A1 | 3/2009 | Kollman | |
| 2009/0107313 | A1 | 4/2009 | Nien et al. | |
| 2010/0107833 | A1 | 5/2010 | Caputo et al. | |
| 2010/0107839 | A1 | 5/2010 | Roberts et al. | |

FOREIGN PATENT DOCUMENTS

| | | | |
|---|---|---|---|
| CN | 101367213 | A | 2/2009 |
| DE | 223048 | | 6/1910 |
| DE | 857677 | | 12/1952 |
| EP | 0265564 | A1 | 4/1988 |
| EP | 0273535 | A1 | 6/1988 |
| EP | 640531 | A1 | 8/1994 |
| EP | 0629475 | A1 | 12/1994 |
| GB | 121338 | | 11/1970 |
| GB | 2258686 | A | 2/1993 |
| GB | 2394458 | A | 10/2003 |
| WO | 0107747 | A1 | 2/2001 |
| WO | 0110408 | A2 | 2/2001 |
| WO | 03010408 | A2 | 2/2003 |

OTHER PUBLICATIONS

U.S. Appl. No. 12/349,771, filed Jan. 7, 2009.
U.S. Appl. No. 29/366,066, filed Jul. 19, 2010.
U.S. Appl. No. 29/366,069, filed Jul. 19, 2010.
U.S. Appl. No. 29/366,071, filed Jul. 19, 2010.
U.S. Appl. No. 29/366,072, filed Jul. 19, 2010.
European Patent Office, Partial European Search Report, Application No. EP11005919.3-1261, Oct. 21, 2011.
Newell Window Furnishings, Inc., European Patent Application No. EP11005919.3-1261, Extended European Search Report, Apr. 2, 2012.
U.S. Appl. No. 12/579,892, filed Oct. 15, 2009.
U.S. Appl. No. 12/579,897, filed Oct. 15, 2009.
U.S. Appl. No. 12/838,975, filed Jul. 19, 2010.
U.S. Appl. No. 12/838,993, filed Jul. 19, 2010.
U.S. Appl. No. 12/838,946, filed Jul. 19, 2010.
U.S. Appl. No. 12/839,027, filed Jul. 19, 2010.
U.S. Appl. No. 12/838,958, filed Jul. 19, 2010.
Newell Window Furnishings, Inc., Canadian Application No. 2,746,791, Office Action, Jan. 23, 2013.
Newell Window Furnishings, Inc., Chinese Application No. 201110259655.7, Office Action, Nov. 1, 2013.
U.S. Appl. No. 10/908,728, Restriction Requirement, Jul. 9, 2007.
U.S. Appl. No. 10/908,728, Office Action, Oct. 4, 2007.
U.S. Appl. No. 10/908,728, Final Office Action, Apr. 30, 2008.
U.S. Appl. No. 10/908,728, Office Action, Oct. 8, 2008.
U.S. Appl. No. 10/908,728, Final Office Action, Apr. 23, 2009.
U.S. Appl. No. 10/908,728, Office Action, Mar. 2, 2011.
U.S. Appl. No. 12/685,843, Restriction Requirement, Jun. 28, 2010.
U.S. Appl. No. 12/685,843, Office Action, Aug. 19, 2010.
U.S. Appl. No. 12/685,843, Final Office Action, Jan. 20, 2011.

* cited by examiner

BLIND PACKAGING AND METHODS OF CUTTING WINDOW COVERINGS

The invention relates generally to window coverings that can be cut-to-size at the point of sale and more particularly to a package that facilitates cutting of the window coverings and a methods of cutting window coverings using the package.

BACKGROUND

It will be appreciated that window coverings come in a variety of materials including wood, plastic, fabric, vinyl and aluminum and a variety of styles including horizontal, woven, pleated, Roman and cellular. Cut-to-size window coverings are sold in a limited number of stock sizes. The end user purchases the window covering at a retail outlet in the stock size that is closest in size to, but is larger than, the window or other architectural feature with which the window covering is to be used. A cutting machine is operated at the retail outlet to cut the window coverings to the desired size.

SUMMARY

A package for a window covering of the type comprising a head rail and having a width that is suitable for use in a cutting machine comprises a box for holding the window covering comprising a top wall and a bottom wall connected by a first side wall and a second side wall and defining a first open end and a second open end. The bottom wall terminating in a first end and the first side wall terminating in a second end. The box having a first portion that extends for the width of the window covering and a second portion that extends for less than the width of the window covering. The second portion being bounded at least in part by the first end and the second end such that the window covering extends beyond the first end of the bottom wall a first distance and the head rail extends beyond the second end of the first side wall a second distance.

The first end and the second end may be equally spaced along the width of the window covering. A first removable end cap may cover the first open end of the box and a second removable end cap may cover the second open end of the box. The window covering may be centered in the box. The first distance may be equal to the second distance. The first distance and the second distance may be equal to a cut zone of the window covering. The cut zone may be at least as long as the maximum length of material that may be cut from one end of the window covering or it may be at least as long as the maximum length of material that may be cut from one end of the window covering and an additional length sufficient to accommodate a clamp for holding the window covering during a cutting operation. A portion of the top wall may extend for the width of the window covering.

A method of cutting a window covering of the type comprising a head rail and a panel having a width comprises providing a stock size window covering in a box as described above; placing the box containing the window covering in front of a cutting device; positioning the box with the bottom wall facing down such that the exposed portion of the window covering is facing down and the exposed portion of the head rail faces a clamp; moving the clamp into engagement with the head rail to compress the window covering; and cutting the window covering and box. The head rail may be cut before the panel. End caps may be removed from the box prior to cutting. The panel may comprise a plurality of adjacent slats and a ladder and the portions of the ladder trapped between two adjacent slats may be limited prior to cutting the window covering and box. An insert may be placed between two adjacent slats prior to cutting the window covering and box.

A method of packaging a window covering comprises providing a stock size window covering comprising a head rail and a plurality of slats supported on the head rail by a ladder; providing a box for holding the window covering in a collapsed condition where loops of the ladder may be trapped between adjacent ones of the plurality of slats; counting the number of loops to determine a total number of loops; comparing the total number of loops to a maximum allowable number of loops; and if the total number of loops exceeds the maximum allowable number of loops, reducing the total number of loops. Counting the loops may include counting the loops on both a front and a back of the window covering. If the adjacent slats have a loop on the front and a loop on the back one loop is added to the total number of loops. The maximum allowable number of loops may be ten. A locking member may engage the head rail of the window covering where the locking member comprises a portion of the box folded into engagement with the head rail.

A method of packaging a window covering comprises providing a stock size window covering comprising a head rail and a plurality of slats supported on the head rail by a ladder; providing a box for holding the window covering in a collapsed condition; positioning a first insert between two adjacent slats, positioning a second insert between the head rail and one of the plurality of slats, and positioning a third insert between the window covering and the box.

DETAILED DESCRIPTION OF EMBODIMENTS OF THE INVENTION

In this application the terms "size-in-store" and "cut-to-size" refer to window coverings that are manufactured in a limited number of predetermined stock widths and that may be cut to a desired size using a cutting machine. The window covering is purposely manufactured in a size that is wider than the window or other architectural feature with which the window covering is intended to be used. It will be appreciated that cut-to-size window coverings may come in a limited number of different stock widths where each width is intended to be used with a range of window widths. Whether a single stock width is provided or several stock widths are provided, the significant feature of these window coverings is that they are provided in stock sizes that are cut to the desired size at the retail level and are not sized for use with a particular size window during the manufacturing process. The window coverings are typically cut to the specific width desired by the end user at the point of sale using cutting machines provided by the window covering manufacturer.

The package and methods of the invention are intended to be used with any type or style of window covering that can be cut to a desired size after manufacture and with any type of cutting machine. The package of the invention has particular applicability with wood and faux wood blinds and with cutting machines that use saws as the cutting devices because of the dust and debris generated during the cutting operation. One such cutting machine is disclosed in copending U.S. application Ser. No. 12/164,839, filed on Jun. 30, 2008 which is incorporated herein by reference in its entirety.

Figure 1:
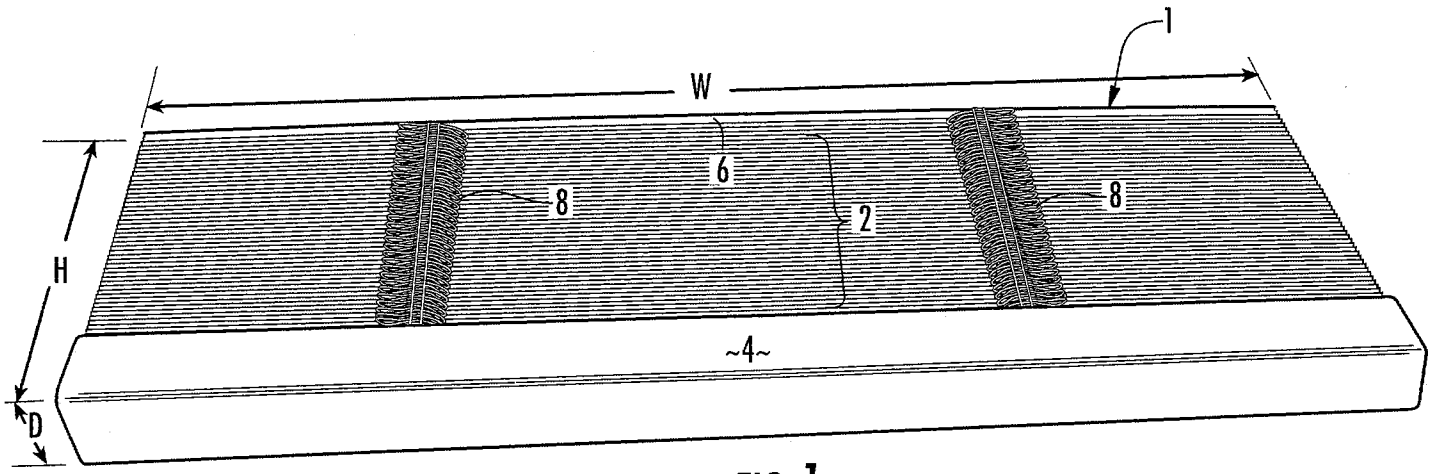
FIG. 1 is a perspective view showing an embodiment of a window covering.
Figure 2:
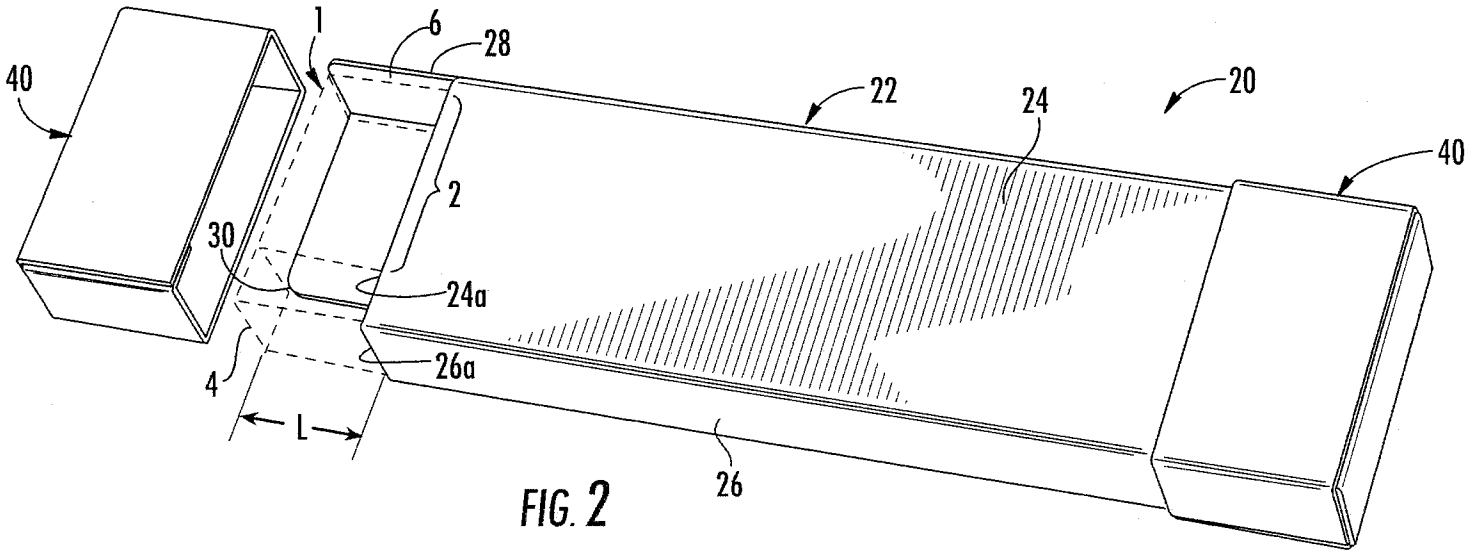
FIG. 2 is a perspective bottom view showing an embodiment of the package of the invention with one end cap removed.
Figure 3:
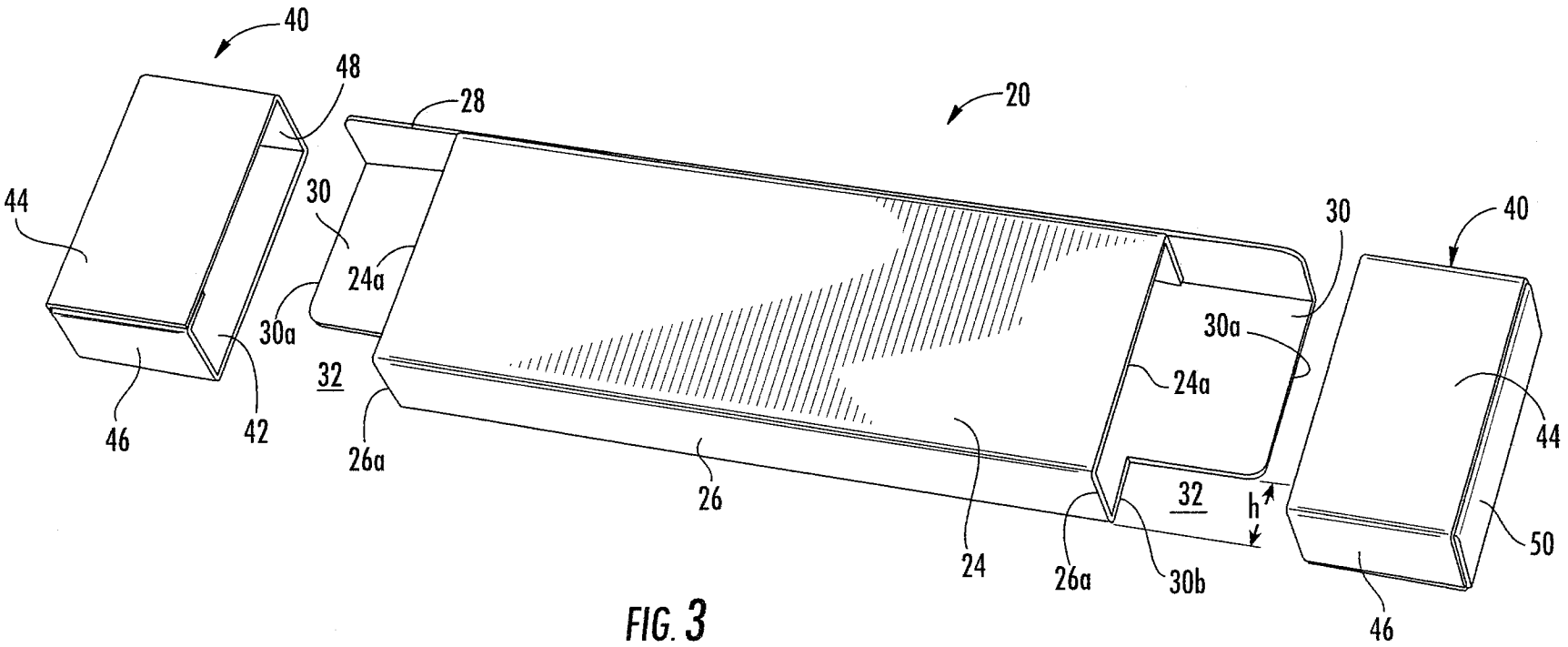
FIG. 3 is a perspective bottom view showing the package of FIG. 2 with both end caps removed.
Figure 4:
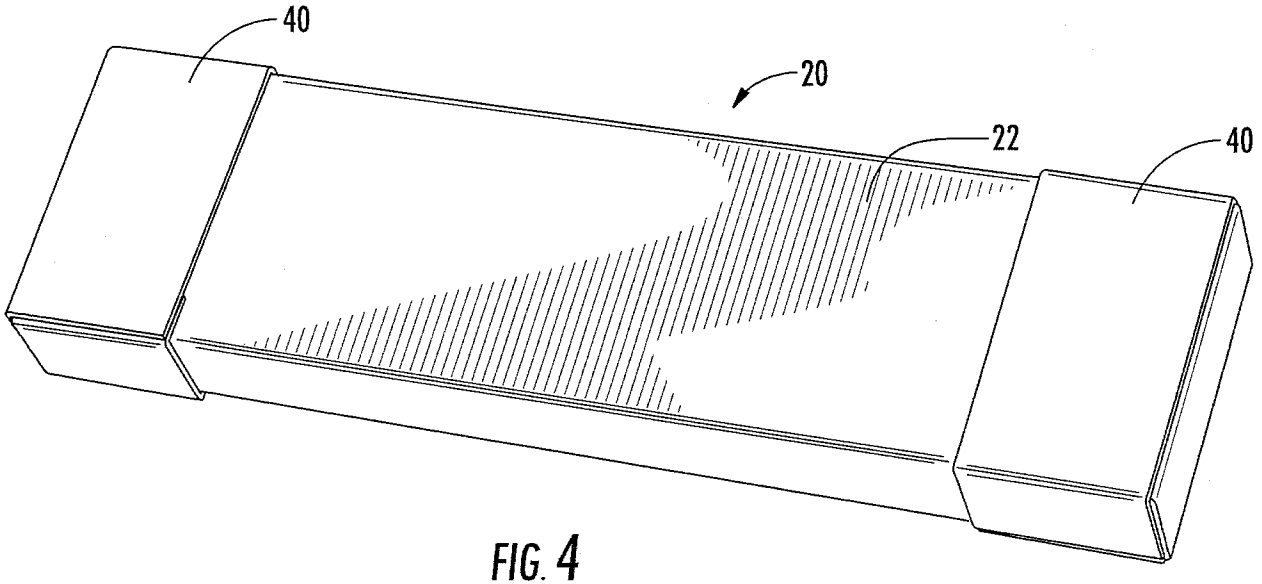
FIG. 4 is a perspective view showing the package of FIG. 2 with both end caps attached.

Referring to FIG. 1 an example window covering construction is shown generally at 1 in a collapsed or raised condition. The window covering typically includes a head rail 4 that supports a panel 2 on lift cords or ladders 8 such that the panel may be raised and lowered relative to the head rail. A bottom rail 6 may be attached to the bottom of the panel. In the illustrated embodiment panel 2 is a slatted horizontal blind and comprises a plurality of slats suspended on ladders 8 from head rail. The head rail may be secured to a window or other architectural feature. A bottom rail 6 attached to the bottom slat. The cords or ladders 8 are woven between the slats 2 to support the slats in spaced relation such that the slats may be raised, lowered and tilted. Separate lift cords may be used with some types of window coverings to raise and lower the window coverings. Other components such as brakes, motors, cord locks or the like may be incorporated in the window covering as is known in the art. Typically, these components are located in a central portion of the head rail 4 where they will not be impacted by the cut-to-size operation. While one embodiment of a horizontal wood blind is illustrated, it is to be understood that the method and apparatus may be used with any cut-to-size window covering. For purposes of explaining the orientation between the window covering 1 and the package, window covering 1 has a width W, height H and depth D. In the typical size-in-store cutting operation, a length of material is cut from each end of the blind to shorten the width W.

FIGS. 2 through 5 show an embodiment of the package used in cutting operation. A package 20 is provided consisting of an open-ended box or sleeve 22 defined by a planar bottom wall 24 and a substantially parallel planar top wall 30 that are connected together by opposed, parallel planar side walls 26 and 28 creating a rectangular container that is open at both ends. The terms "top" and "bottom" are used to denote the orientation of the box 22 when it is properly positioned in a cutting machine during the cutting operation. The window covering is oriented in box 22 such that it is centered in the box with the head rail 4 adjacent side wall 26 and the bottom rail adjacent side wall 28. A valance may also be supported in box 20 between the bottom rail and side wall 28 such that it extends beyond the ends of window covering 1.

The box 22 defines an interior space that is dimensioned to closely receive a window covering 1 where that the ends of the window covering extend just beyond, and are exposed at, the open ends of the box. The ends of the window covering extend slightly beyond the ends of the box 22 to allow the ends to be squared before being cut. The dimensions of the internal space of box 22 are slightly greater than the external dimensions of the collapsed window covering such that when window covering 1 is placed in box 22 the window covering components are trapped between the top, bottom and side walls to fix the window covering components in an aligned position relative to one another.

In one embodiment package 20 is manufactured from cardboard but package 20 may be made of plastic or any other material that can be cut using size-in-store cutting machines. Typically, box 22 is formed of a cardboard blank folded to the final shape and secured together by adhesive staples or the like, although any manufacturing method may be used.

One of the side walls 28 is dimensioned to have a depth and width that is substantially the same as the depth and width of the window covering such that side wall 28 extends for substantially the full width W and depth D of the window covering 1. The opposite side wall 26 has a depth that is substantially the same or slightly greater than the depth of the window covering such that side wall 26 extends for the full depth D of the window covering; however, side wall 26 has a width dimension that is less than the width W of the window covering 1 such that side wall 28 extends for less than the full width of the window covering. As a result, a length L of each end of the window covering extends beyond the ends 26*a* of side wall 26.

Likewise, the bottom wall 24 has a height that is substantially the same or slightly greater than the height H of the window covering 1 such that bottom wall 24 extends for the height H of the window covering; however, bottom wall 24 has a width dimension that is less than the width W of the window covering such that bottom wall 24 extends for less than the full width of the window covering. The bottom wall 24 and side wall 26 have the same width dimension and the window covering 1 is centered in the box 22 such that substantially the same length of window covering L extends beyond both ends 24*a* of bottom wall 24 and both ends 26*a* of side wall.

The top wall 30 extends for the substantially the full width W and height H of the window covering 1 except that a cut out area 32 extends into top wall 30 from end 30*a* of the top wall 30. Each cut out area 32 is bounded by a recessed end 30*b* of top wall 30 such that the portion of the top wall 30 between cut out areas 32 has the same width as bottom wall 24 and side wall 26. Recessed end 30*b* is in substantially the same plane as ends 26*a* and 24*a* of the side wall 26 and bottom wall 24. Each cut out area 32 extends for a height h that corresponds substantially to the height of the head rail 4. The cut out areas 32 expose a length L of the head rail 4 on the top of box 22. Because the top wall 30 extends for substantially the full width of the window covering (except for cut out area 32), the top wall covers the top of the panel 2 to prevent dust and debris from being propelled upward during the cutting operation. It should be understood that walls 28 and 30 extend for substantially the entire length of the window covering except for a small distance sufficient to allow the window covering components to be squared relative to one another.

By dimensioning the walls as described, the head rail 4 is exposed on three sides for length L and the panel 2 and bottom rail 6 are exposed on the bottom of the box 22 for length L. By leaving portions of the window covering uncovered by the box 22 dust and debris is allowed to fall from the window covering and package during and after the cutting operation and the window covering may be better compressed during the cutting operation as will hereinafter be described.

The distance L between the end of the window covering 1 and the end 24*a* of the bottom wall 24, the end 26*a* of the side wall 26 and the end 30*b* of the top wall 30 corresponds to the cut zone for the window covering. The cut zone comprises the predetermined length of material that may be cut from each end of the window covering and may include an additional length to accommodate a clamp for holding the window covering during the cutting operation. For any size and type of window covering a predetermined maximum length of material M (FIGS. 5 and 9) may be cut from each end of the window covering. The predetermined maximum length of material M that may be cut from each end of a window covering is limited by the size of the window covering, the placement of the lift ladders, lift cords, cord locks, etc. and the window covering structure and is known value for any type of window covering.

Figure 5:
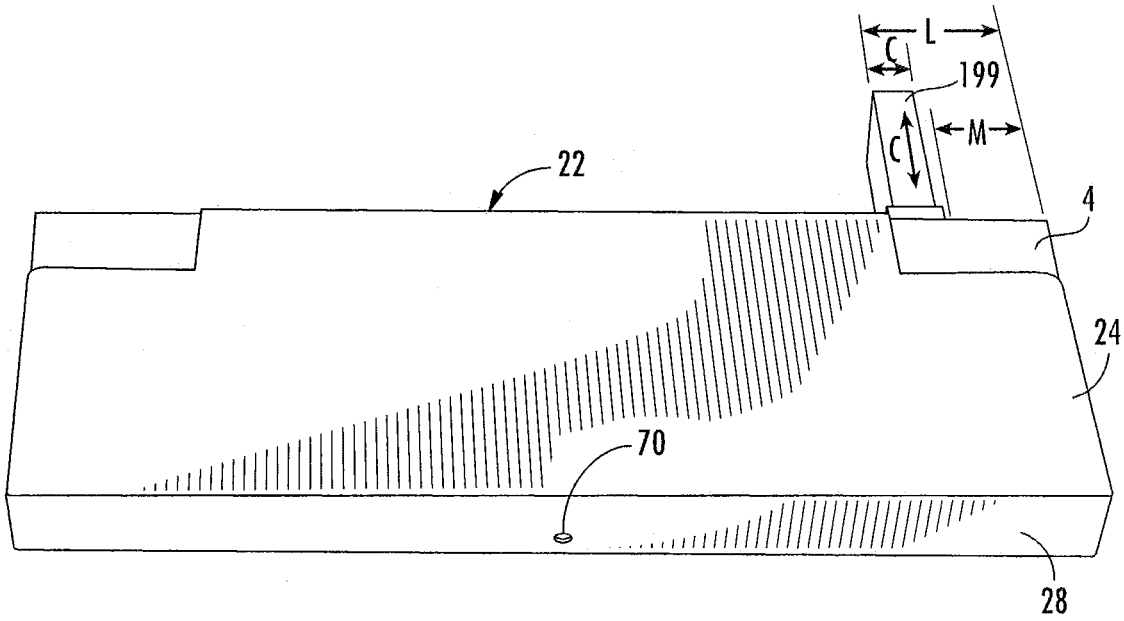
FIG. 5 is a perspective top view of the package of FIG. 2.
Figure 9:
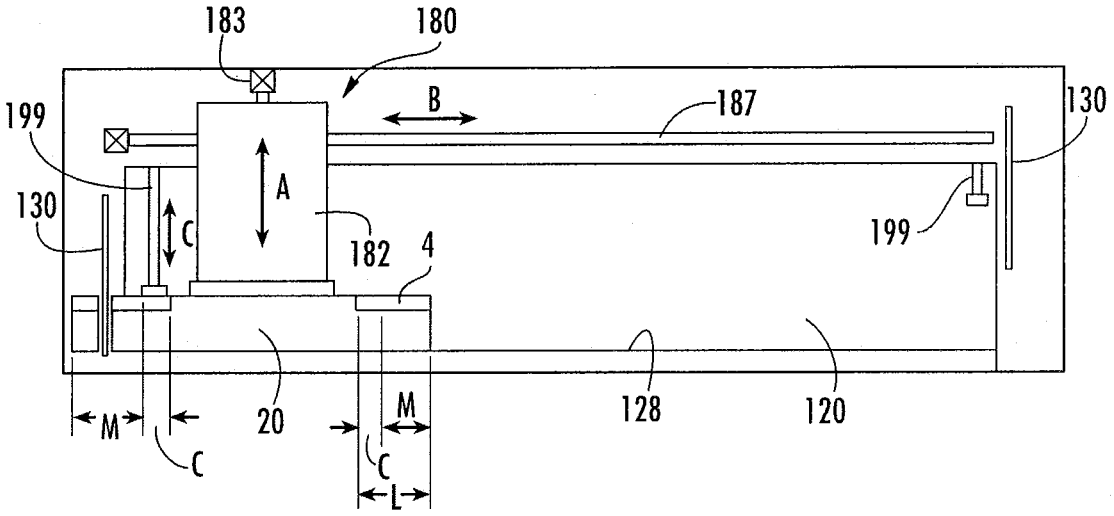
FIG. 9 is a top view of an embodiment of a cutting machine.

In order to explain the cut zone an exemplary embodiment of a cutting machine will be described with reference to FIGS. 5 and 9. A platform 120 supports the window covering 1 and box 22 during the measuring and cutting operations. The platform 120 typically comprises a substantially flat surface that is dimensioned to be able to receive and support a range of window covering sizes. Located along an edge of the platform 120 is a lateral support surface 128 that may be defined by a plurality of rollers. The lateral support surface 128 facilitates the movement of the window covering across the platform 120 during the measuring and cutting operations. During the measuring and cutting operations, the window covering may be pressed against the lateral support surface 128 and slid across the platform 120 by a clamp assembly 180 comprising a clamping jaw 182. Clamping jaw 182 is supported for reciprocating linear movement along the direction of arrow A by a linear drive 183 such as a rack and pinion or ball screw drive or the like such that the clamping jaw 182 may be selectively reciprocated toward and away from surface 128 to clamp and release the window covering and package. A second linear drive 187, such as a rack and pinion or ball screw drive or the like, reciprocates clamp assembly 180 in the direction of arrow B along the length of the platform 120 to position the clamp assembly 180 relative to saws 130 that are located at each end of platform 120. When clamping jaw 182 is extended in the direction of arrow A the window covering and package 20 are pressed against lateral support surface 128. The clamp assembly 180 may then be moved relative to platform 120 in the direction of arrow B to position the window covering and package in front of saws 130.

After clamp assembly 180 properly positions the window covering in front of one of the saws 130 a stationary clamp 199 is extended as represented by arrow C to press the end of the window covering against the lateral support surface 128 during the cutting operation. The saws 130 are reciprocated transversely to the platform 120 to cut the window covering. While one embodiment of an automatic cutting machine is shown, the package 20 may be used with any blind cutting machine including automatic, semi-automatic and manual cutting machines.

The width of the clamp 199 is defined as distance C. The cut zone may include not only the predetermined maximum length of material M that may be cut from each end of the window covering but also a length equal to or slightly greater than the width of the clamp C where the length of the cut zone is equal to M+C. Thus, the length of the exposed area L between the end of the window covering 1 and the ends 24*a*, 26*a* and 30*a* of box 22 is equal to or slightly greater than the length of the cut zone. As a result, length L of the window covering that is exposed along the bottom and one side of the box 22 is equal to M+C. The head rail 4 is exposed such that it may be directly contacted by clamp 199 and the cut area M of the window covering is exposed along the bottom of box 22 to void dust and debris.

For transport, storage and display purposes end caps 40 cover the open ends of the box 22. Each end cap 40 comprises a top wall 42, bottom wall 44 and side walls 46, 48 that are dimensioned such that the end caps 40 fit over the open ends of box 22 and window covering 1. Each end cap 40 also includes an end wall 50 that closes the open end of the box 22 and covers the end of the window covering 1. In addition to enclosing the ends of the window covering the end walls 50 may also be used to align the window covering components such that the ends of the head rail 4, panel 2 and bottom rail 6 are in a common plane. The window covering components may also be aligned in a common plane in the cutting machine by a squaring block or as a separate automated step prior to the cutting operation. The end caps 40 may be secured to the box 22 by any releasable connection including a shrink wrap, adhesive, tear-away tabs, tabs and slots or the like. The end caps 40 are removed from box 22 prior to cutting and may be replaced on the box 22 after the cutting operation to retain the cut window covering in box 22.

The cutting machine may include a pin or other engagement structure that extends into and engages a hole formed on the window covering 1 and/or package 20 to fix the position of the window covering on the cutting machine. Aperture 70 is provided in one of the walls of package 20 to receive the engagement structure on the cutting machine. In the illustrated embodiment, the aperture 70 is formed in side wall 28.

The function and operation of the package 20 in a size-in-store machine will now be described. A suitable stock size window covering packaged in package 20 is selected based on the desired final dimension (Block 1001). The end caps 40 are removed from the box 22 (Block 1002). The box 22 containing the window covering is positioned in the cutting machine with the cutting zone positioned in front of the saw or other cutting device (Block 1003). The box 22 may be automatically positioned in front of the saw as described with reference to FIG. 9 or it may be manually positioned in front of the saw.

The box 22 is positioned with the bottom wall 24 facing down such that the exposed area of the window covering is facing down and the exposed head rail faces the clamp 199 and saw 30 (Block 1004).

The clamp 199 may be moved into engagement with the head rail 4 of window covering 1 adjacent edge 26*a* (Block 1005). Because the clamp 199 applies the clamping force directly to the window covering, rather than on a package containing the window covering, the clamping force compresses the components 2, 4 and 6 into a tight engagement with one another (Block 1006). Because the top wall 30 extends for the full width of the window covering (except for cut out area 32), the top wall covers the top of the panel 2 to prevent dust and debris from being propelled upward during the cutting operation. The tight engagement of the window covering components provides a higher quality cut and prevents dust and debris from entering into the box 22 between the components. The open area at the bottom of the box 22 allows the dust and debris created during the cutting operation to be voided from the window covering and package via the exposed portions of the window covering by dropping under the force of gravity, by being drawn out by a vacuum or by being blown out by an air source (Block 1007). The window covering is oriented such that the saw cuts the head rail before cutting the slats such that dust and debris funneled through the head rail during cutting of the panel is minimized (Block 1007).

Figure 6:
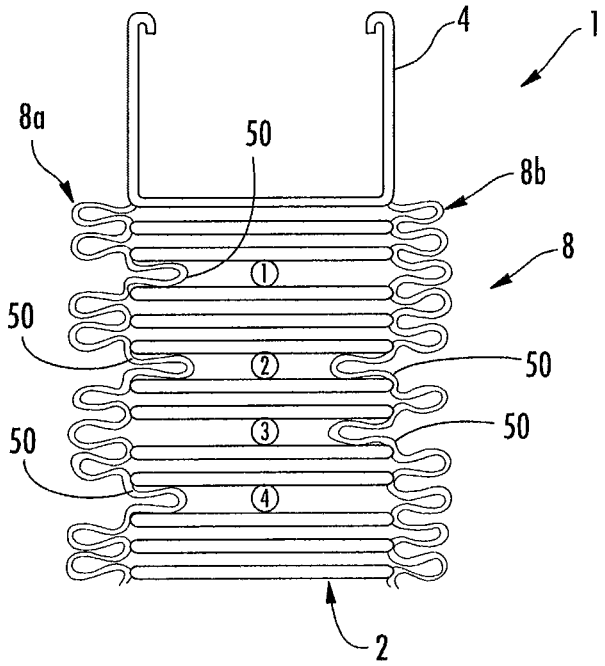
FIG. 6 is a side view of a window covering illustrating a packaging system of the invention.

To further minimize the dust and debris funneled into the window covering and box 22 during the cutting operation, the inventors have determined that the amount of ladder material caught between adjacent slats 2 affects the amount of dust and debris propelled into the box 22. Referring to FIGS. 1 and 6, ladders 8 typically comprise a cord or tape that supports and suspends the individual slats 2 from the head rail 4. The ladder typically includes a portion 8*a* extending down the front of the panel 2 and a portion 8*b* extending down the back of the panel 2. A typical window covering comprises two or more ladders 8 spaced along the width of the slats. When the window covering is in the collapsed position with the slats 2 closely adjacent to one another as shown in FIGS. 1 and 6 and as stored in package 20, some portions of the ladders 8 may become trapped between adjacent slats 2 such that the slats 2 remain spaced from one another even when clamp 199 compresses the window covering. A ladder portion that is trapped between slats is referred to herein as a loop 50. The spaces between the slats 2 caused by the loops 50 create conduits or passageways that allow the entrance of dust and debris into the window covering 1 and box 22. It has been determined that in order to provide a window covering in package 20 that is suitably free of dust and debris to be acceptable to a user a maximum number of loops 50 are allowable. Prior to cutting, and in one embodiment during packaging of the window covering, for each individual ladder 8 the loops 50 are counted and totaled on both the front and the back of the window covering (Block 1101). If the same two slats have a loop 50 on the front and a loop 50 on the back it counts as one loop toward the total number of loops (Block 1102). Referring to FIG. 6, four total loops 50 are shown. Space 1 has one front loop, space 2 has both a front loop and back loop, space three has one back loop and space 4 has one front loop for a total of four loops (space 2 counts as only one loop because both loops are between the same two slats). Once the loops 50 are totaled, the total number of loops is compared with a maximum allowable number of loops (Block 1103). If the total number of loops exceeds the maximum allowable number of loops (Block 1104), the window covering must be repackaged and some of the loops must be removed from between the slats to lower the total number of loops to be at or below the maximum allowable number of loops (Block 1105). If the total number of loops is at or below the maximum allowable number of loops (Block 1104), the window covering is ready to be cut (Block 1106) and may be packaged and/or cut. In one embodiment it has been determined that the maximum number of loops for an acceptably dust free cut window covering is ten.

Figure 7:
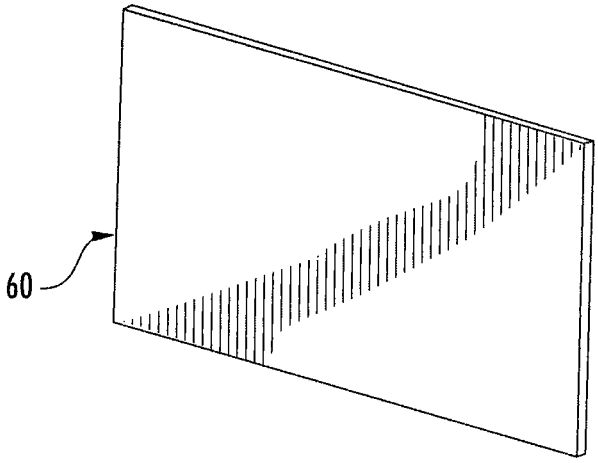
FIG. 7 is a perspective view showing an embodiment of an insert usable in the package of the invention.
Figure 8:
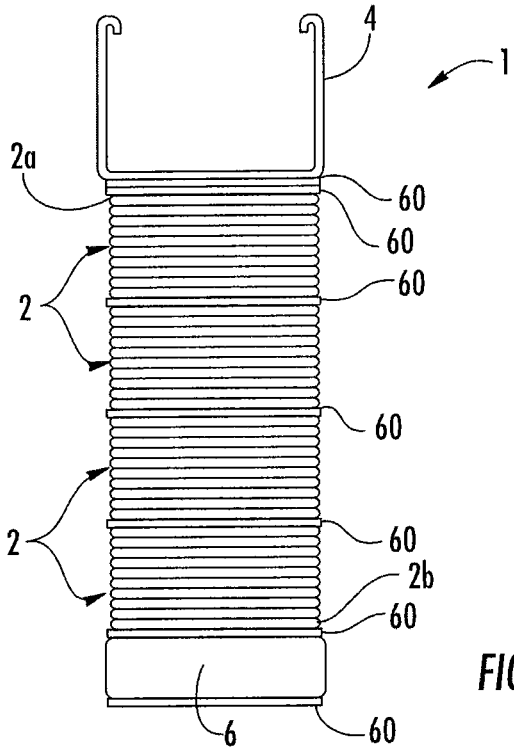
FIG. 8 is a side view of a window covering illustrating use of the insert of FIG. 7.
Figure 10:
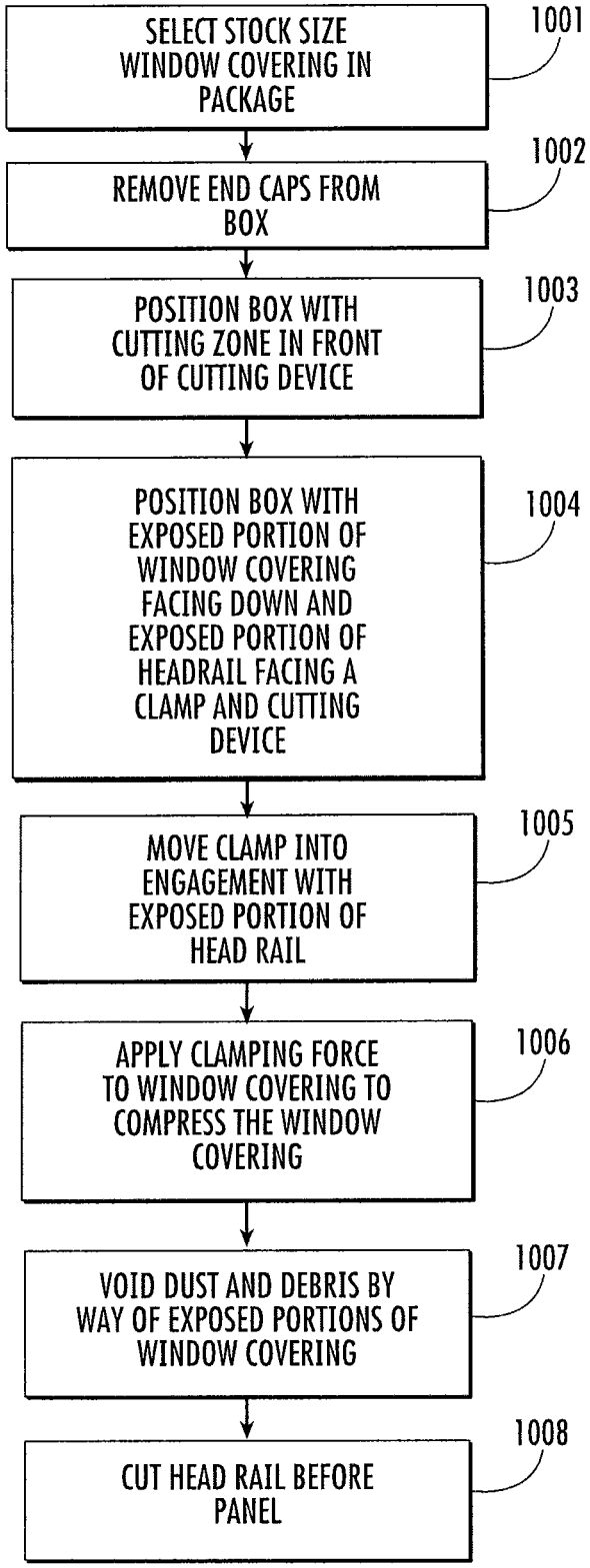
FIG. 10 is a flow chart illustrating a method of cutting a blind using the package described herein.
Figure 11:
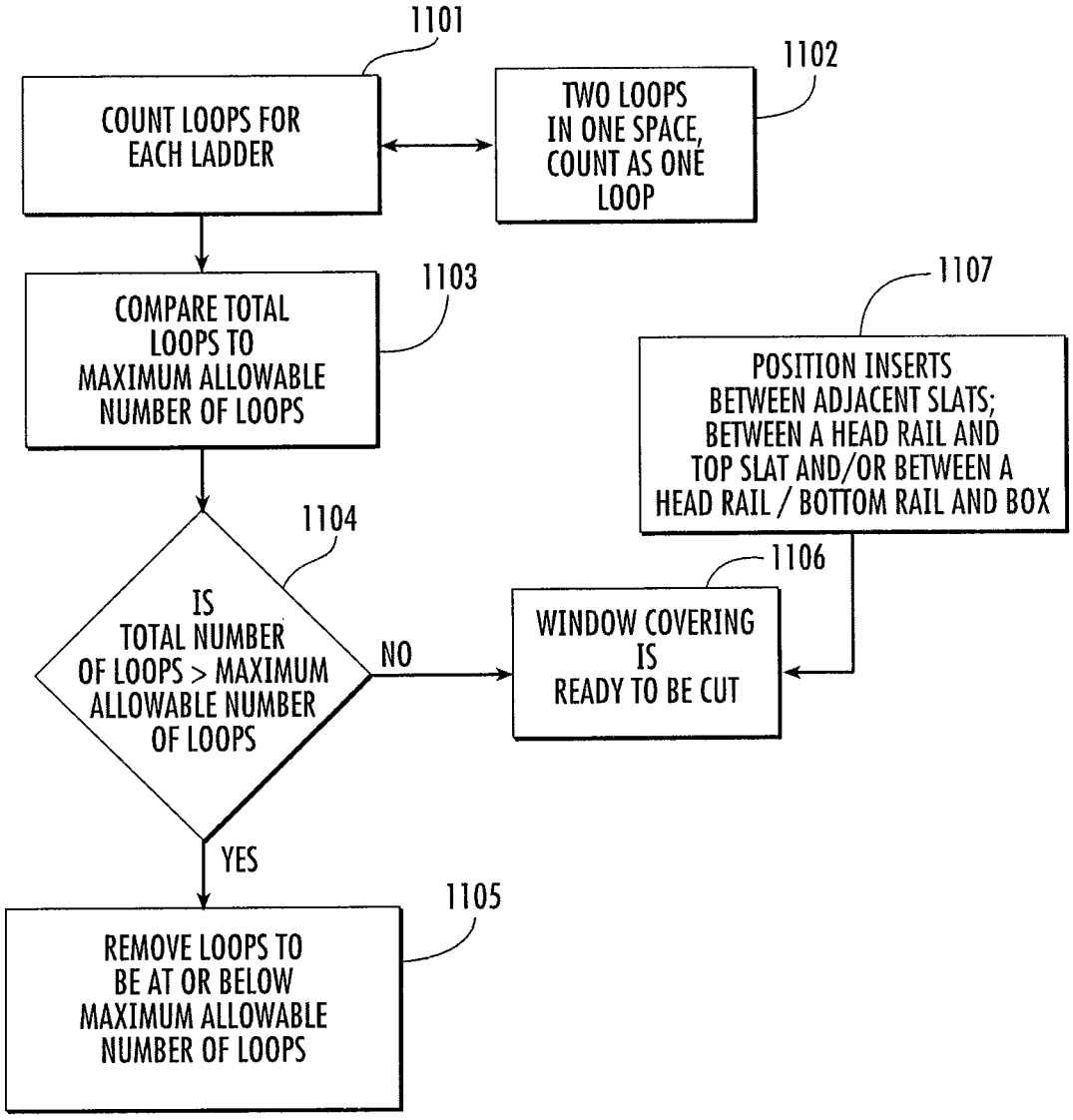
FIG. 11 is a flow chart illustrating a method of packaging a blind using the package described herein.
Figure 12:
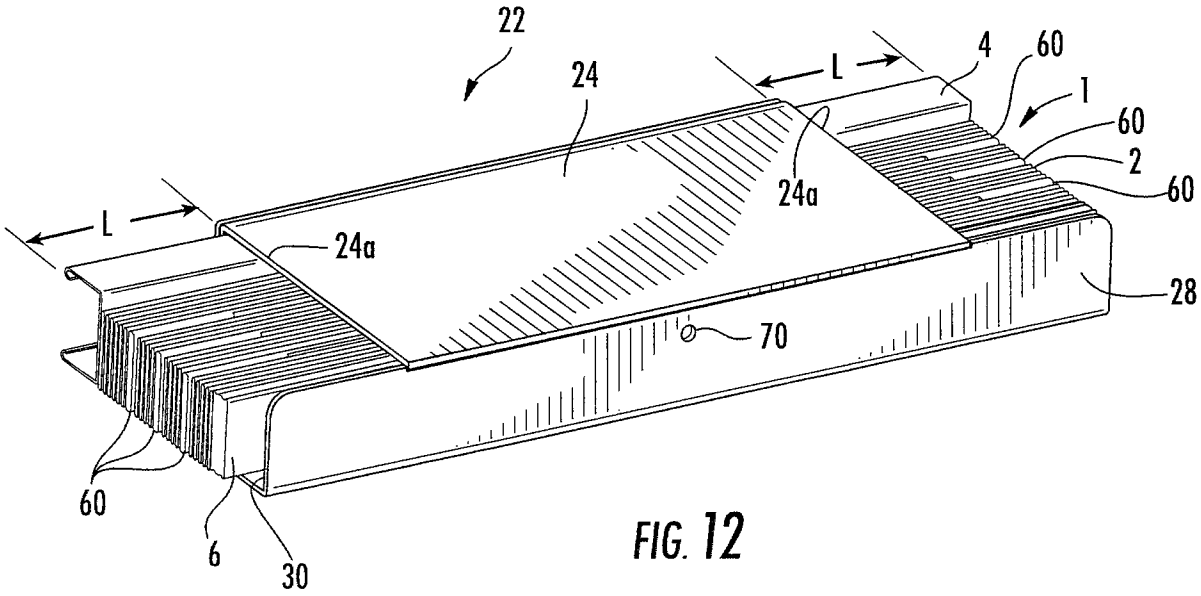
FIG. 12 is a perspective bottom view showing the package of FIG. 2 with a window covering 1 in the package.

Referring to FIGS. 7 and 8, another device to minimize the amount of dust and debris propelled into the window covering and package during cutting is shown. Inserts 60 may be disposed between the window covering components where the inserts 60 act as dams to prevent the flow of dust and debris into the window covering and box 22 and allow the clamp to better compress the window covering components together. The inserts 60 comprise rectangular blocks of relatively stiff but moderately compressible material such as chip board. Chip board is pressed fiber thick paper, usually made from recycled paper. The inserts 60 fit between adjacent slats of the window covering. The inserts 60 are dimensioned to extend for approximately the depth of the slats and to extend from the end of the slats through the cut zone. In one embodiment the inserts 60 are approximately 4 inches wide and 1/16 of an inch thick. When the clamp 199 compresses the window covering the inserts 60 are trapped and compressed between adjacent window covering components to form a barrier that prevents dust and debris from entering the package between the slats. Referring the FIG. 8 it has been found that placing inserts 60 between the head rail 4 and top slat 2*a*, between the bottom rail 6 and the bottom slat 2*b*, between the bottom rail 6 and side wall 28 of box 22 and positioning three additional inserts 60 at equally spaced intervals along the slats provides an adequate dust barrier, although a greater or fewer number of inserts may be used (Block 1107). It has also been determined that doubling the thickness of the insert between the head rail 4 and top slat is most effective.

Figure 14:
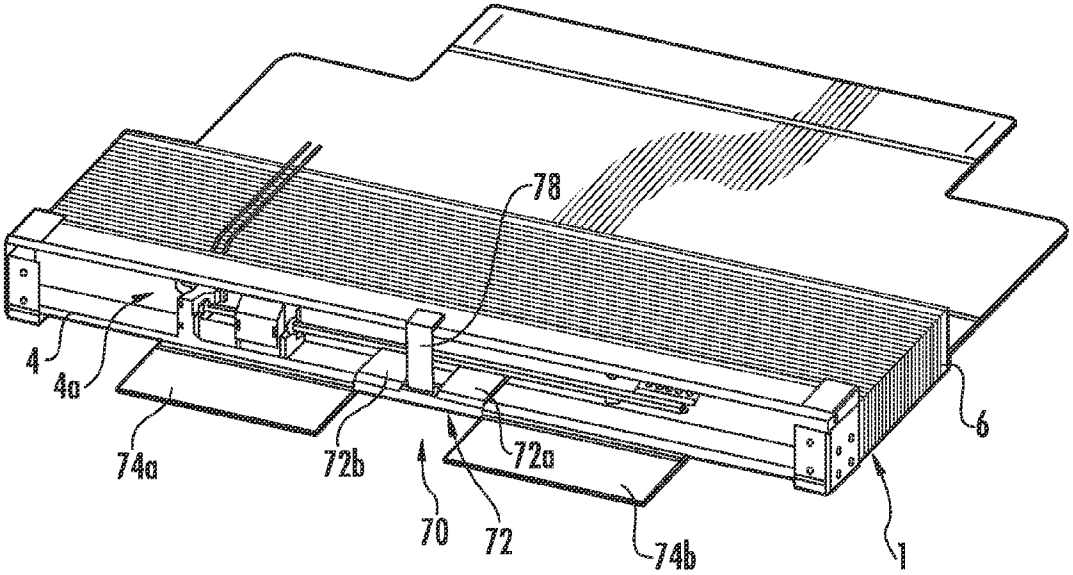
FIGS. 13 and 14 are perspective top views showing the blank and formation of the package of FIG. 2.
Figure 13:
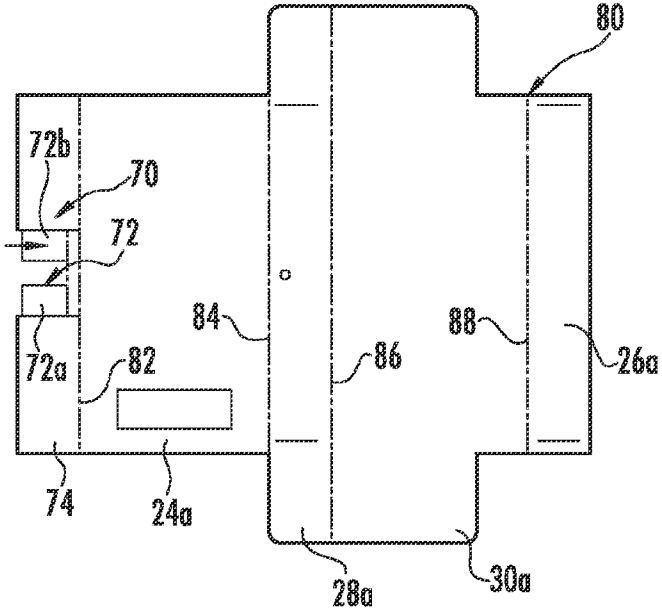

Referring to FIGS. 13 and 14, a retaining member 70 extends from the box 22 for retaining the window covering in box 22. It is possible for the window covering 1 to slide out of the box 22 when the end caps 40 are removed and the box 22 is oriented with one of the ends of the package facing down. The retaining member 70 retains the window covering 1 in the box even after the end caps 40 of the package are removed.

In the illustrated embodiment the retaining member 70 comprises a flap 72 that is cut out of the panel 74 such that it can be folded along line 76 to extend into the interior of the head rail 4. The flap 72 comprises a first leg 72*a* and a second film 72*b* that are positioned such that the one leg extends to either side of center bracket 78. The center bracket 78 is secured to the head rail 4 at the center thereof. The flap 72 retains the window covering in the box 22 even after the end caps 40 of the package 20 are removed due to the physical engagement between the legs 62*a*, 62*b* of flap 62 and center bracket 78. While retaining member 70 is shown as a flap cut out and folded from the box blank 80, the retaining member may be a separate element secured to the box 22.

To form the box 22 a blank 80 is formed such as from card board. The blank comprises a panel 24*a* formed between fold line 82 and 84 that forms the bottom wall 24 of the box 22. Panel 74 is formed between the fold line 82 and the end of the blank. The panel 74 is folded against the top of the head rail 4 and legs 72*a* and 72*b* are folded into the open space 4*a* of head rail 4 to surround the center bracket 78 that is connected to head rail 4. Portions 74*a* and 74*b* of panel 74 are folded against the head rail 4. Panel 28*a* is formed between the fold line 84 and fold line 86. Panel 28*a* is folded against the bottom rail 6 to form side wall 28. Panel 30*a* is formed between fold line 86 and fold line 88. Panel 30*a* is folded against the window covering to form top wall 3. Panel 26*a* is formed between the fold line 88 and the end of the blank 80 and is folded along line 88 against the outside of panel portions 74*a* and 74*b* to form side wall 26.

Specific embodiments of an invention are described herein. One of ordinary skill in the art will recognize that the invention has other applications in other environments. In fact, many embodiments and implementations are possible. The following claims are in no way intended to limit the scope of the invention to the specific embodiments described above.

The invention claimed is:

1. A package and a window covering comprising:

a window covering comprising a head rail and a panel and having a first width between a first end and a second end of the window covering, the window covering being configured for use in a cutting machine to reduce the width, wherein the window covering comprises:

a first cut zone that defines a first length of material that may be cut from adjacent the first end; and a second cut zone that defines a second length of material that may be cut from adjacent the second end;

wherein the first length of material and the second length of material extend for a predetermined width of the window covering from the first end and the second end, respectively;

wherein the window covering is packaged in a box that comprises a top wall and a bottom wall connected by a first side wall and a second side wall, wherein the respective walls of the box define a first open end and a second open end;

wherein:

the top wall of the box comprises a first portion having a second width substantially equal to the first width, such that the first portion of the top wall extends for substantially the first width and substantially covers the panel, such that the first portion of the top wall extends over the first cut zone and the second cut zone;

the bottom wall of the box comprises a third width where the third width is less than the first width such that the first end and the second end of the window covering extend beyond the bottom wall a distance, wherein the distance is equal to or greater than the predetermined width, such that the bottom wall does not extend over the first cut zone and the second cut zone;

the top wall comprises a second portion having a fourth width that is less than the second width such that the first end and the second end of the window covering extend beyond the second portion a distance, wherein the distance is equal to or greater than the predetermined width, such that the second portion of the top wall does not extend over the first cut zone and the second cut zone, wherein the difference between the second width and the fourth width defines a cut out area that exposes the head rail in the cut zone; and the first side wall of the box comprises a fifth width that is equal to the second width, such that the first side wall extends for substantially the first width and substantially covers the panel, and the first side wall extends over the first cut zone and the second cut zone.

2. The package and window covering of claim 1 further including a first removable end cap for covering the first open end of the box and a second removable end cap for covering the second open end of the box.

3. The package and window covering of claim 1 wherein the window covering is centered in the box.

4. The package and window covering of claim 1 wherein the first length is equal to the second length.

5. The package and window covering of claim 1 wherein the predetermined width of the first cut zone is at least as long as the first length of material and an additional length sufficient to accommodate a clamp for holding the window covering during a cutting operation.

6. The package and window covering of claim 1 further including a retaining member for engaging the window covering in the box to retain the window covering in the box.

7. The package and window covering of claim 6 wherein the retaining member comprises a portion of the box folded into engagement with a portion of the window covering.

8. The package and window covering of claim 6 wherein the retaining member engages the head rail.

9. The package and window covering of claim 1 wherein the second side wall has a sixth width, the sixth width being equal to the fourth width such that such that the first end and the second end of the window covering extend beyond the second side wall a distance where the distance is at least as great as the predetermined width.

* * * * *